United States Patent [19]

Murakami et al.

[11] Patent Number: 4,592,322

[45] Date of Patent: Jun. 3, 1986

[54] APPARATUS FOR THROTTLE VALVE CONTROL

[75] Inventors: Terukiyo Murakami, Yokosuka; Minoru Tamura, Yokohama; Hideaki Inoue, Yokosuka, all of Japan

[73] Assignee: Nissan Motor Company, Limited, Yokohama, Japan

[21] Appl. No.: 738,987

[22] Filed: May 29, 1985

[30] Foreign Application Priority Data

| | | | |
|---|---|---|---|
| May 30, 1984 | [JP] | Japan | 59-109815 |
| Jul. 13, 1984 | [JP] | Japan | 59-144497 |
| Jul. 13, 1984 | [JP] | Japan | 59-144498 |
| Jul. 13, 1984 | [JP] | Japan | 59-144499 |

[51] Int. Cl.[4] ..... F02D 9/00

[52] U.S. Cl. ..... 123/361; 123/399

[58] Field of Search ..... 123/361, 399, 403, 395

[56] References Cited

U.S. PATENT DOCUMENTS

| | | | |
|---|---|---|---|
| 4,506,642 | 3/1985 | Dfalzgraf et al. | 123/361 |
| 4,519,360 | 5/1985 | Murakami | 123/361 |
| 4,519,361 | 5/1985 | Murakami | 123/361 |
| 4,523,561 | 6/1985 | Koruge | 123/361 |

*Primary Examiner*—Raymond A. Nelli

*Attorney, Agent, or Firm*—Schwartz, Jeffery, Schwaab, Mack, Blumenthal & Evans

[57] ABSTRACT

An apparatus for use with an automotive vehicle for controlling movement of a throttle valve in response to a change of the position of an accelerator pedal. A control circuit receives electrical signals indicative of accelerator-pedal and throttle-valve positions for calculating a value corresponding to a setting of the position of the throttle valve. The control circuit is connected to an actuator which moves the throttle valve to the calculated setting. The control circuit decreases the speed of closing movement of the throttle valve when the throttle valve position is at an angle less than a reference angle.

15 Claims, 22 Drawing Figures

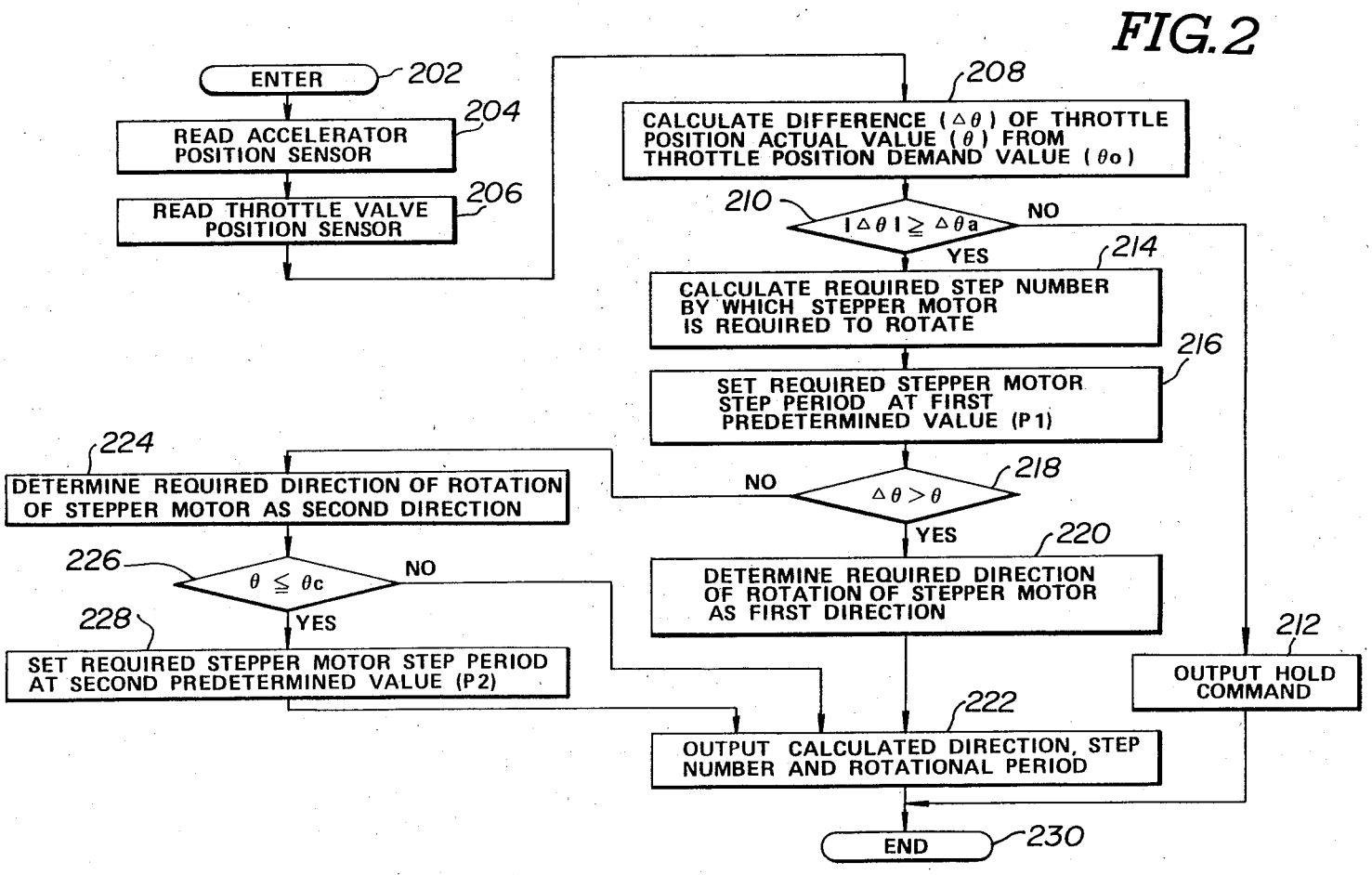
FIG. 2
ENTER
202
READ ACCELERATOR POSITION SENSOR
204
READ THROTTLE VALVE POSITION SENSOR
206
CALCULATE DIFFERENCE (Δθ) OF THROTTLE POSITION ACTUAL VALUE (θ) FROM THROTTLE POSITION DEMAND VALUE (θo)
208
|Δθ| ≧ Δθa
210
NO
YES
CALCULATE REQUIRED STEP NUMBER BY WHICH STEPPER MOTOR IS REQUIRED TO ROTATE
214
OUTPUT HOLD COMMAND
212
SET REQUIRED STEPPER MOTOR STEP PERIOD AT FIRST PREDETERMINED VALUE (P1)
216
Δθ > θ
218
NO
YES
DETERMINE REQUIRED DIRECTION OF ROTATION OF STEPPER MOTOR AS FIRST DIRECTION
220
OUTPUT CALCULATED DIRECTION, STEP NUMBER AND ROTATIONAL PERIOD
222
END
230
DETERMINE REQUIRED DIRECTION OF ROTATION OF STEPPER MOTOR AS SECOND DIRECTION
224
θ ≦ θc
226
NO
YES
SET REQUIRED STEPPER MOTOR STEP PERIOD AT SECOND PREDETERMINED VALUE (P2)
228

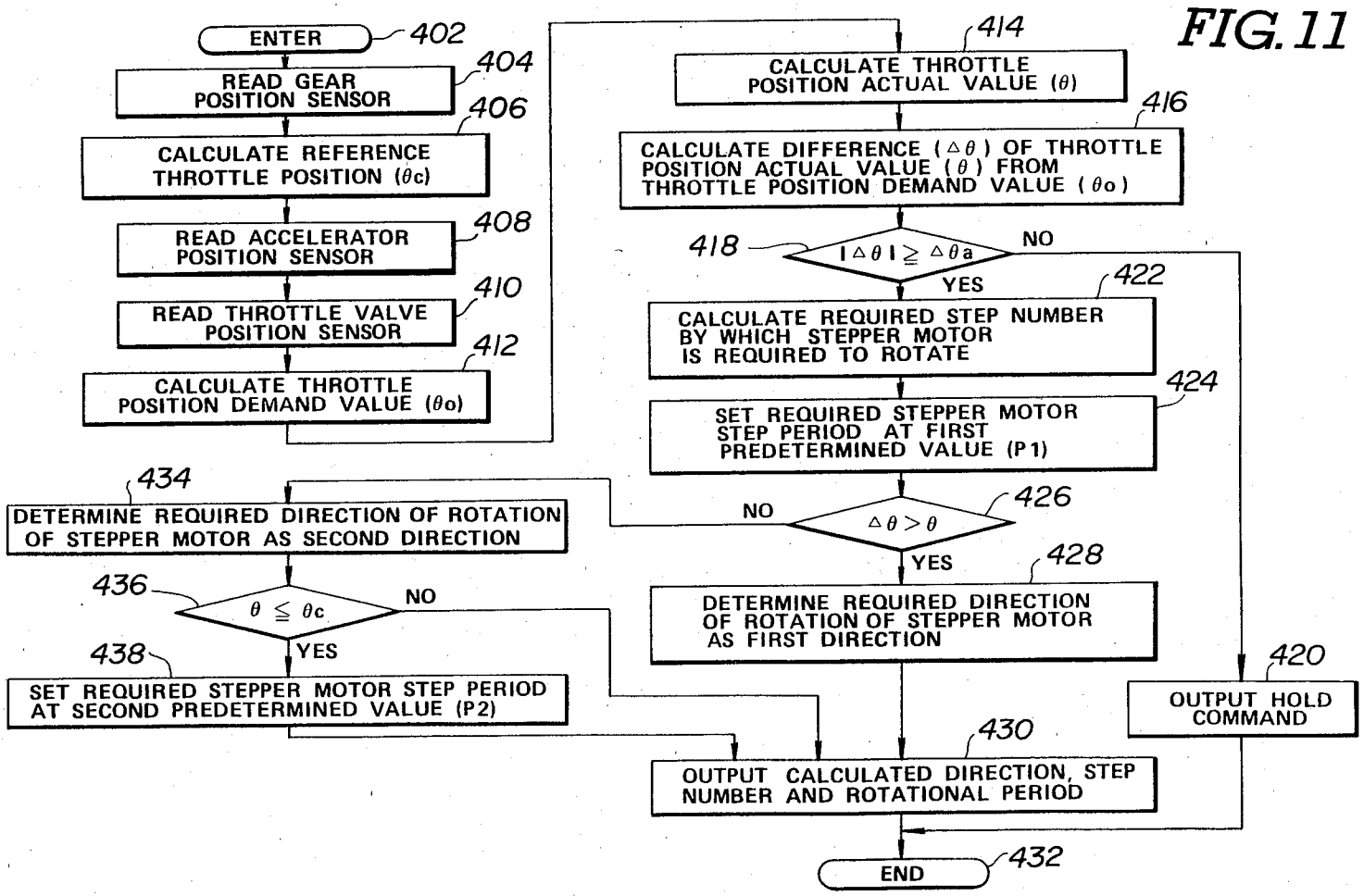
FIG. 11
ENTER
402
READ GEAR POSITION SENSOR
404
CALCULATE REFERENCE THROTTLE POSITION (θc)
406
READ ACCELERATOR POSITION SENSOR
408
READ THROTTLE VALVE POSITION SENSOR
410
CALCULATE THROTTLE POSITION DEMAND VALUE (θo)
412
CALCULATE THROTTLE POSITION ACTUAL VALUE (θ)
414
CALCULATE DIFFERENCE (Δθ) OF THROTTLE POSITION ACTUAL VALUE (θ) FROM THROTTLE POSITION DEMAND VALUE (θo)
416
|Δθ| ≧ Δθa
418
NO
YES
OUTPUT HOLD COMMAND
420
CALCULATE REQUIRED STEP NUMBER BY WHICH STEPPER MOTOR IS REQUIRED TO ROTATE
422
SET REQUIRED STEPPER MOTOR STEP PERIOD AT FIRST PREDETERMINED VALUE (P1)
424
Δθ > θ
426
NO
YES
DETERMINE REQUIRED DIRECTION OF ROTATION OF STEPPER MOTOR AS FIRST DIRECTION
428
DETERMINE REQUIRED DIRECTION OF ROTATION OF STEPPER MOTOR AS SECOND DIRECTION
434
θ ≦ θc
436
NO
YES
SET REQUIRED STEPPER MOTOR STEP PERIOD AT SECOND PREDETERMINED VALUE (P2)
438
OUTPUT CALCULATED DIRECTION, STEP NUMBER AND ROTATIONAL PERIOD
430
END
432

FIG.12
| GEAR POSITION | REFERENCE ANGLE ($\theta c$) |
|---|---|
| G1 | Oc1 |
| G2 | Oc2 |
| G3 | Oc3 |
| G4 | Oc4 |
| G5 | Oc5 |
FIG.14
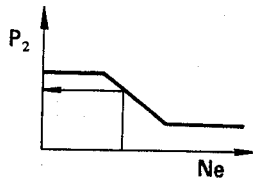
FIG.15
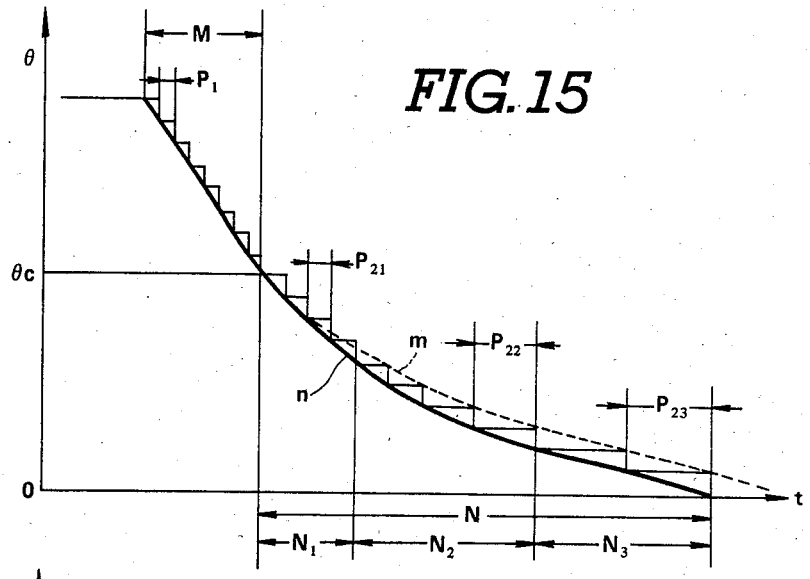
FIG.16
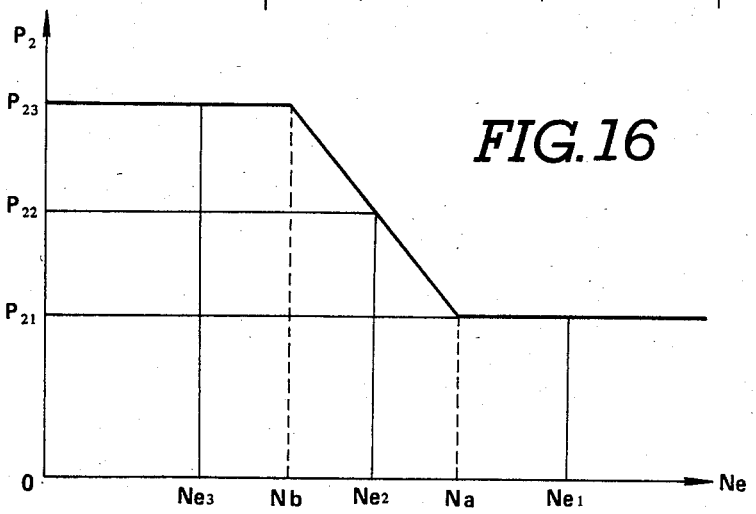

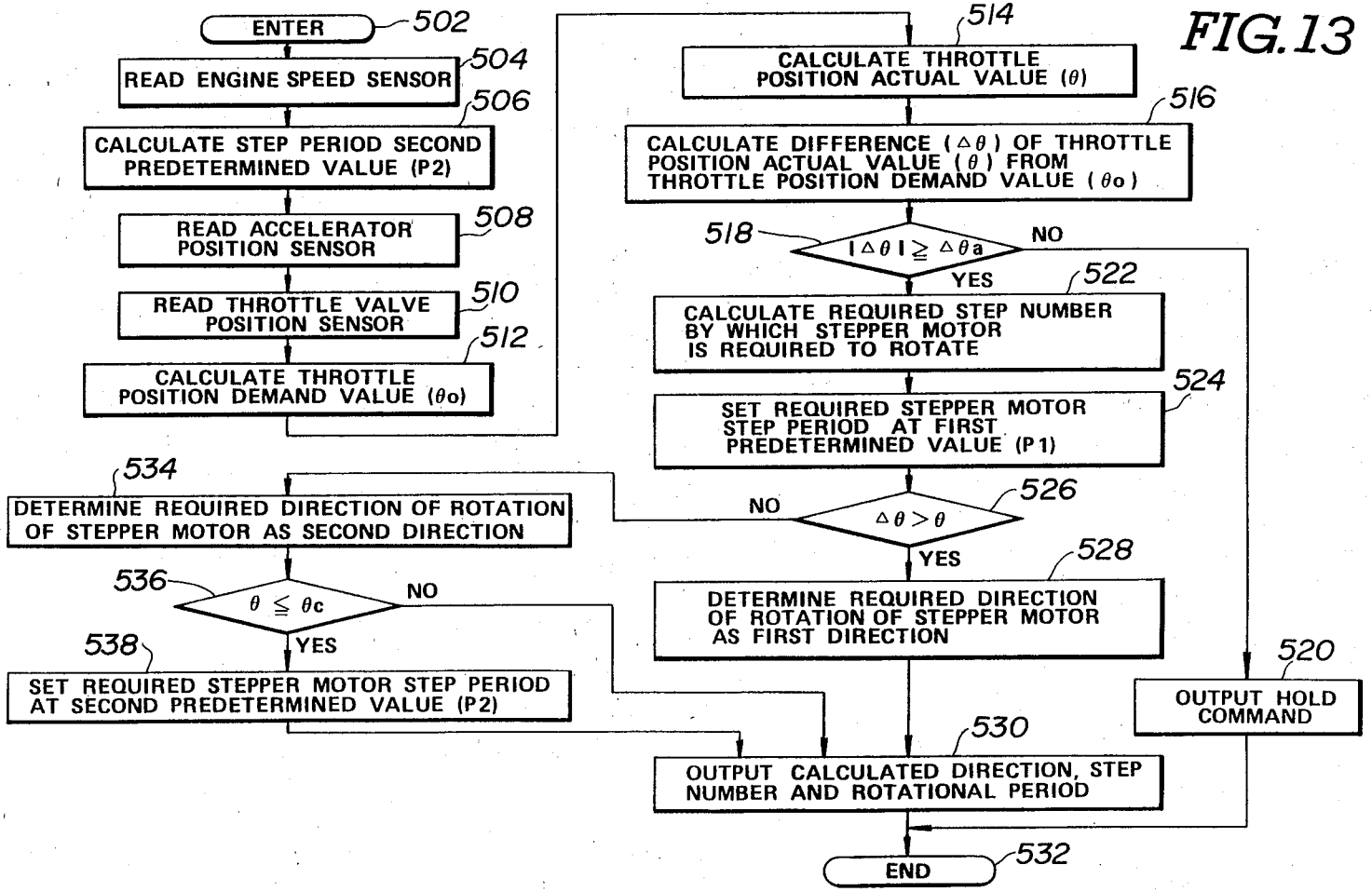
FIG. 13
ENTER
502
READ ENGINE SPEED SENSOR
504
CALCULATE STEP PERIOD SECOND PREDETERMINED VALUE (P2)
506
READ ACCELERATOR POSITION SENSOR
508
READ THROTTLE VALVE POSITION SENSOR
510
CALCULATE THROTTLE POSITION DEMAND VALUE (θo)
512
CALCULATE THROTTLE POSITION ACTUAL VALUE (θ)
514
CALCULATE DIFFERENCE (Δθ) OF THROTTLE POSITION ACTUAL VALUE (θ) FROM THROTTLE POSITION DEMAND VALUE (θo)
516
|Δθ| ≧ Δθa
518
NO
YES
CALCULATE REQUIRED STEP NUMBER BY WHICH STEPPER MOTOR IS REQUIRED TO ROTATE
522
SET REQUIRED STEPPER MOTOR STEP PERIOD AT FIRST PREDETERMINED VALUE (P1)
524
Δθ > θ
526
NO
YES
DETERMINE REQUIRED DIRECTION OF ROTATION OF STEPPER MOTOR AS FIRST DIRECTION
528
OUTPUT HOLD COMMAND
520
OUTPUT CALCULATED DIRECTION, STEP NUMBER AND ROTATIONAL PERIOD
530
END
532
DETERMINE REQUIRED DIRECTION OF ROTATION OF STEPPER MOTOR AS SECOND DIRECTION
534
θ ≦ θc
536
NO
YES
SET REQUIRED STEPPER MOTOR STEP PERIOD AT SECOND PREDETERMINED VALUE (P2)
538

| GEAR POSITION | STEP PERIOD (P2) |
|---|---|
| G1 | Pg1 |
| G2 | Pg2 |
| G3 | Pg3 |
| G4 | Pg4 |
| G5 | Pg5 |

APPARATUS FOR THROTTLE VALVE CONTROL

BACKGROUND OF THE INVENTION

This invention relates to an apparatus for controlling movement of a throttle valve in response to a change in the position of an accelerator pedal.

In order to meter the amount of mixture to an internal combustion engine, a variable positionable throttle valve is situated within the induction passage of the engine. Normally, a mechanical link mechanism is provided to couple the throttle valve to an accelerator pedal in a manner to move the throttle valve in response to movement of the accelerator pedal. If the throttle valve closes at a high speed to its idle position during deceleration, the intake-manifold negative pressure would increase to an excessive extent causing an intake air density reduction and a great amount of fuel collected on the intake passage walls being evaporated and drawn into the combustion chambers so as to create an over-rich fuel-air mixture, resulting in increased HC emissions, engine misfire, after-burning, and torque fluctuations which are a source of uncomforatable torsional vibration of the engine.

It is conventional practice to slow down the speed of closing movement of the throttle valve by using a mechanical dashpot device to retard closing of the throttle valve when the throttle valve position is at an angle less than a predetermined value. With such a mechanical dashpot device, however, attachment errors affect the angle at which the dashpot device starts retarding closing of the throttle valve, resulting in inaccurate throttle valve control.

Therefore, the present invention provides an improved throttle valve control apparatus which can control throttle valve closing movement with greater accuracy.

SUMMARY OF THE INVENTION

There is provided, in accordance with the present invention, an apparatus for use with an automotive vehicle having an accelerator pedal and a throttle valve for controlling movement of the throttle valve in response to a change in the position of the accelerator pedal. The apparatus comprises signal sources for generating an electrical signal indicative of the position of the accelerator pedal and an electrical signal indicative of the position of the throttle valve. A control circuit calculates a value corresponding to a setting of the position of the throttle valve in response to the accelerator-pedal and throttle-valve position signals. The control circuit is connected to an actuator which moves the throttle valve to the calculated setting. The control circuit compares the throttle valve position with a reference angle and decreases the speed of closing movement of the throttle valve when the throttle valve position is at an angle equal to or less than the reference angle.

BRIEF DESCRIPTION OF THE DRAWINGS

This invention will be described in greater detail by reference to the following description taken in connection with the accompanying drawings, in which

FIG. 2 is a flow diagram of the programming of the digital computer used in the apparatus of FIG. 1;

FIG. 11 is a flow diagram of the programming of the digital computer used in a third embodiment of the present invention;

FIG. 12 is a table showing the relationship programmed into the digital computer;

FIG. 13 is a flow diagram of the programming of the digital computer used in a fourth embodiment of the present invention;

FIG. 14 is a graph showing the relationship programmed into the computer;

FIGS. 15 and 16 are graphs used to explain the operation of the fourth embodiment;

DETAILED DESCRIPTION OF THE PREFERRED EMBODIMENTS

Figure 1:
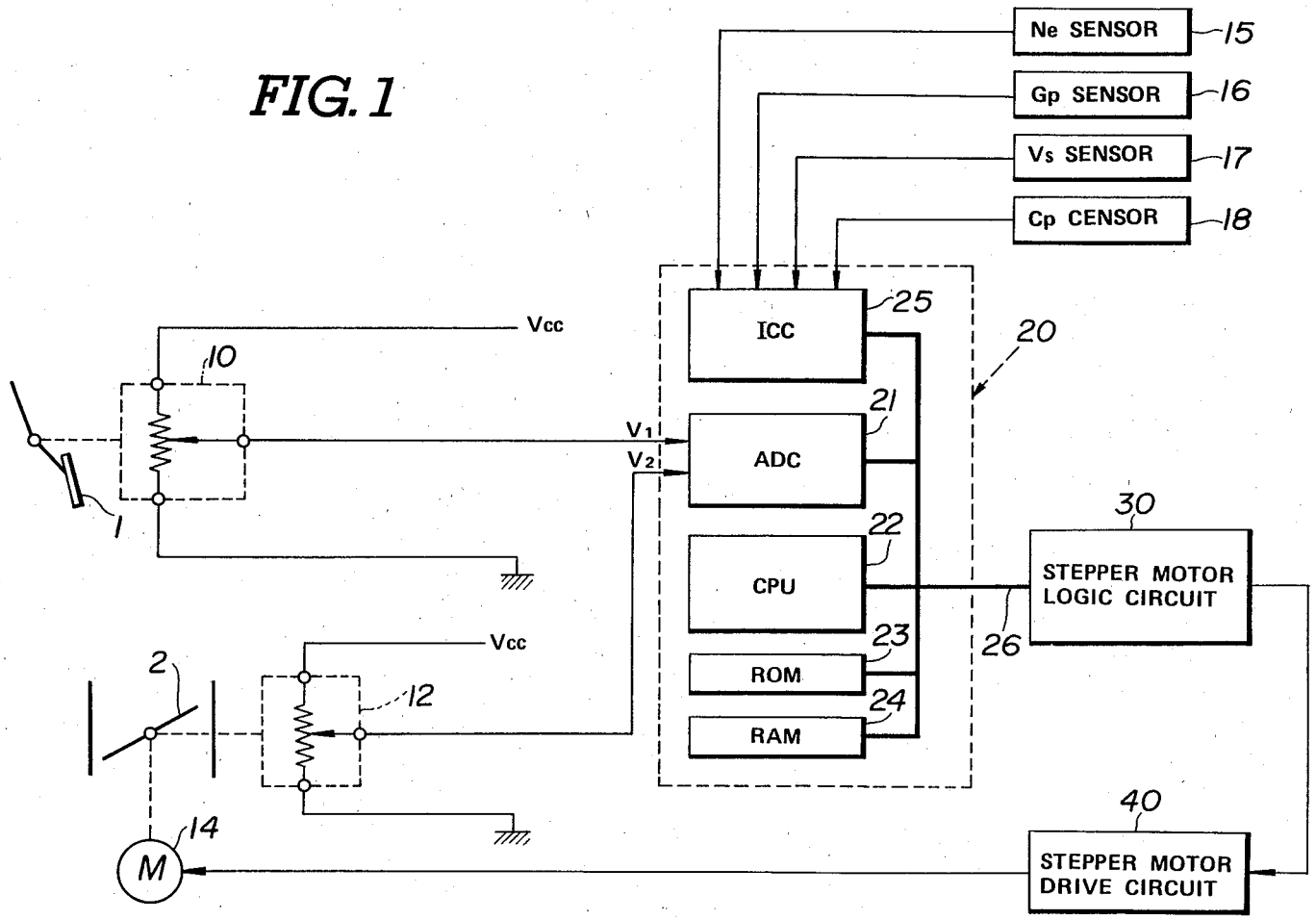
FIG. 1 is a block diagram showing one embodiment of a throttle valve control apparatus made in accordance with the present invention.

With reference to the drawings and in particular to FIG. 1, there is shown a schematic block diagram of an automobile throttle valve control apparatus embodying the present invention. The throttle valve control system includes a control circuit 20 which electrically controls movement of a throttle valve 2 situated within the induction passage of the engine in response to a demand from an accelerator device such for example as an accelerator pedal 1. For this purpose, the control circuit 20 receives an input signal from an accelerator pedal position sensor 10. The accelerator pedal position sensor 10 generates an analog signal V1 corresponding to the amount of depression of an accelerator pedal 1. The accelerator pedal position sensor 10 is shown as including a potentiometer connected between a voltage source Vcc and electrical ground. The resistance of the potentiometer is a function of the extent to which the accelerator pedal 1 is depressed. The wiper arm of the potentiometer is operatively connected to the accelerator pedal 1 to change the resistance value of the potentiometer as the accelerator pedal moves between its fully released and depressed positions.

The control circuit 20 is used in a closed loop system having a throttle valve position sensor 12 which provides a feedback signal causing the control circuit 20 to move the throttle valve 2 to a desired position. The throttle valve position sensor 10 generates an analog signal V2 corresponding to the degree of opening of the throttle valve 2. The throttle valve position sensor 12 is shown as including a potentiometer connected between as voltage source Vcc and electrical ground. The resistance of the potentiometer is a function of the angle to which the throttle valve 2 moves. The wiper arm of the potentiometer is operatively connected to the throttle valve 2 to change the resistance value of the potentiometer as the throttle valve moves between its fully open and closed positions. It is to be noted that the throttle valve position sensor 12 may be removed when the control circuit 20 is used in an open loop system as will be described later.

The throttle valve 2 is connected by a mechanical linkage to a stepper motor 14. The stepper motor is electrically controlled and it determines the setting of the throttle valve 2, which, in turn, determines the amount of air admitted to the engine.

If desired in controlling the position of the throttle valve 2, the control circuit 20 may have additional inputs from sensors including an engine rotational speed sensor 15, a transmission gear position sensor 16, a vehicle speed sensor 17, and a clutch position sensor 18. The engine rotational speed sensor 15 generates a signal indicative of the speed or rotation of the engine crankshaft. The engine rotational speed sensor may be arranged to monitor the current flow through the primary winding of the ignition coil of the engine. The transmission gear position sensor 16 generates a signal indicative of the selected gear position of the transmission. The vehicle speed sensor 17 generates a signal indicative of the speed of running of the vehicle. The clutch position sensor 18 generates a signal indicative of the clutch being in its engaged or disengaged position.

The control circuit 20 determines the required new setting, at a given time, of the throttle valve position in the form of the direction in which the stepper motor 14 is to rotate, the period in which the stepper motor is to rotate one step, and the step number by which the stepper motor is to rotate. The control circuit 20 outputs the required new setting information, in the form of binary number signal, to a stepper motor control logic circuit 30. The actual setting of the throttle valve 2 is accomplished with the stepper motor 14 and its drive circuit 40. The stepper motor control logic circuit 30 converts the binary-number setting information into the number and period of pulses required to move the throttle valve to its required new setting. The stepper motor control logic circuit 30 generates an electronic control signal of the determined period to the stepper motor drive circuit 40. The stepper motor drive circuit 40 actuates the stepper motor 14 by one step in each determined period to vary the position of the throttle valve 2.

The control circuit 20 includes a center processing unit (CPU) 22, an analog-to-digital converter (ADC) 21, a read only memory (ROM) 23, and a read/write memory (RAM) 24. If desired, the control circuit 20 may includes an input control circuit (ICC) 25 which receives input signals from the sensors 15 to 18. The CPU 22 communicates with the rest of the microcomputer via data bus 26. The analog-to-digital converter 21 receives the voltage signals V1 and V2 from the accelerator-pedal and throttle-valve position sensors 10 and 12, respectively. The A to D conversion process is initiated on command from the CPU 22 which selects the input channel to be converted. At the end of the conversion cycle, the analog-to-digital converter 21 generates an interrupt after which the data is read over the data bus on command from the CPU 22.

The ROM 23 contains the program for operating the CPU 22 and further contains appropriate data in look-up tables used in calculating appropriate values for the position of the throttle valve 2. The look-up data may be obtained experimentally or derived empirically. The CPU 22 may be programmed in a known manner to interpolate between the data at different entry points if desired. Control words specifying a desired throttle valve position are periodically transferred by the CPU 22 to the stepper motor control logic circuit 30.

FIG. 2 is a flow diagram illustrative of the operation of the digital computer used in the control circuit 22 to calculate required stepper motor rotational direction, step number and step period. The computer program is entered at the point 202 at constant time intervals. Following this, the accelerator-pedal and throttle-valve position signals V1 and V2 are, one by one, converted by the analog-to-digital converter 21 into digital form. Thus, at the point 204 in the program, the accelerator pedal position signal V1 is converted to digital form and read into the computer memory 24. This read value indicates a demand value $\theta o$ for the throttle valve position. Similarly, at the point 206, the throttle valve position signal V2 is converted to digital form and read into the computer memory 24. This read value indicates an actual value $\theta$ for the throttle valve position.

At the point 208 in the program, the central processing unit 22 calculates the difference $\Delta\theta$ of the actual value $\theta$ from the demand value $\theta o$. At the following point 210, a determination is made as to whether or not the absolute value $|\Delta\theta|$ of the calculated difference $\Delta\theta$ is greater than a predetermined value $\Delta\theta a$ which is intended to provide a dead zone. If the answer to this question is "no", then it means that the demand throttle valve change is within the dead zone and the program proceeds to the point 212. At the point 212, the central processing unit 22 outputs a hold command to the stepper motor control logic circuit 30 which thereby inhibits any stepper motor rotation so as to retain the throttle valve 2 at the existing position. Following this, the program proceeds to the end point 230.

Figure 3:
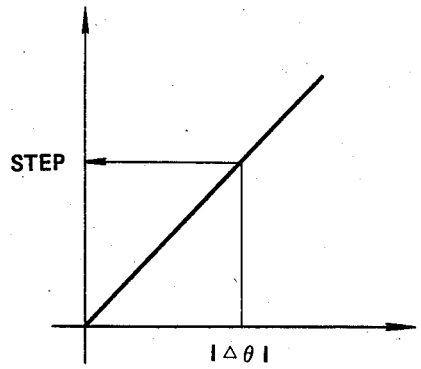
FIG. 3 is a graph showing the relationship programmed into the computer.

If the answer to the question inputted at the point 210 is "yes", then the program proceeds to the point 214 where the central processing unit 22 calculates the number of steps by which the stepper motor 14 is required to rotate in each cycle of execution of this programming from a relationship programmed into the computer. This relationship is shown in FIG. 3 and it defines required step number STEP as a function of the absolute value $|\Delta\theta|$ of the calculated difference $\Delta\theta$. As shown in FIG. 3, the calculated step number STEP increases as the absolute value $|\Delta\theta|$ of the calculated difference increases. As a result, the stepper motor 14 rotates increased number of steps as the rate at which the accelerator pedal 1 is depressed or released increases.

At the point 216 in the program, the required step period, which corresponds to the period in which the stepper motor 14 is to rotate by one step, is set at a first predetermined value (P1). It is to be noted that the step period P is in inverse proportion to the required speed of rotation of the stepper motor 14 and thus to the speed of movement of the throttle valve 2. At the following point 218, a determination is made as to whether or not the calculated difference $\Delta\theta$ is greater than zero or positive. The sign of the calculated difference $\Delta\theta$ is positive when the required new setting $\theta o$ of the throttle valve 2 is greater than the sensed throttle valve position $\theta$ and it is negative when the former is less than the latter. If the answer to this question is "yes", then the program proceeds to the point 220 where the direction in which the stepper motor 14 is to rotate is determined as a first direction moving the throttle valve 2 in an opening direction. Following this, the program proceeds to the point 222 where the central processing unit 22 transfers the calculated new setting information in the form of the determined direction, the calculated step number and the calculated step period via the data bus 26 to the stepper motor control logic circuit 30 at the end of one cycle of execution of the computer program. The program proceeds from this point to the end point 230.

If the answer to the question inputted at the point 218 is "no", then the program proceeds to the point 224 where the direction in which the stepper motor 14 is to rotate is determined as a second direction moving the throttle valve in a closing direction. Following this, the program proceeds to the determination point 224. This determination is as to whether or not the actual value $\theta$ for the throttle valve position is equal to or less than a predetermined value $\theta c$. If the answer to this question is "no", then the program proceeds to the point 222 where the central processing unit 22 transfers the calculated new setting information including the determined direction, the calculated step number and the calculated step period via the data bus 26 to the stepper motor control logic circuit 30 at the end of one cycle of execution of the computer program. The program proceeds from this point to the end point 230.

If the answer to the question inputted at the point 226 is "yes", then the program proceeds to the point 228. At the point 228, the required step period, which corresponds to the period in which the stepper motor 14 is to rotate by one step, is set at a second predetermined value P2 greater than the first predetermined value P1. Following this, the program proceeds to the point 222 where the central processing unit 22 transfers the calculated data including the determined direction, the calculated step number and the calculated step period via the data bus 26 to the stepper motor control logic circuit 30 at the end of one cycle of execution of the computer program. The program proceeds from this point 222 to the end point 230.

The stepper motor control logic circuit 30 includes a digital computer which stores the data transferred from the control circuit 20, calculates an appropriate bit pattern for the position of the throttle valve 2 based upon the stored data, and converts the calculated bit pattern into a corresponding pulse signal. The pulse signal is applied to the stepper motor drive circuit 40 which thereby rotates the stepper motor 14 to move the throttle valve 2 to its required new setting.

Figure 4:
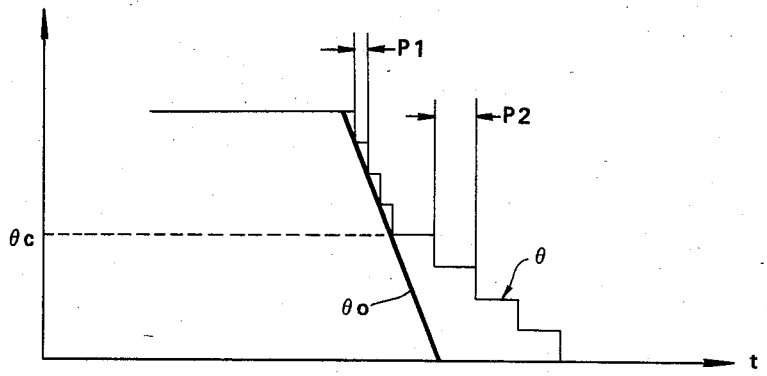
FIG. 4 is a diagram used to explain the operation of the throttle valve control apparatus.

As shown in FIG. 4, the control circuit 22 is responsive to a demand for movement of the throttle valve 2 in a closing position for setting a first predetermined value P1 for the time period P of one step of rotation of the stepper motor 14 so as to move the throttle valve at a relatively high speed when the throttle valve position is at an angle equal to or greater than a predetermined value $\theta c$ and a second, greater, predetermined value P2 for the time period P of one step of rotation of the stepper motor 14 so as to move the throttle valve at a relatively low speed when the throttle valve position is at an angle less than the predetermined value $\theta c$. The control circuit 20 selects the first predetermined value P1 for the time period of one step of rotation of the stepper motor 14 so as to move the throttle valve at a relatively high speed in response to a demand for movement of the throttle valve in an opening direction.

It is, therefore, apparent that the throttle valve control system performs the same function as conventional mechanical dashpot devices used in retarding closing of the throttle valve when the throttle valve position is at an angle less than a predetermined value. The electrical throttle valve control system can provide a more stable and more accurate throttle valve control than conventional mechanical dashpot devices.

An exessive intake-manifold negative-pressure increase made during deceleration would cause an intake air density reduction and a great amount of fuel collected on the intake passage walls being evaporated and drawn into the combustion chambers so as to create an over-rich fuel-air mixture, resulting in increased HC emissions, engine misfire, after-burning, and torque fluctuations which are a source of uncomfortable torsional vibration of the engine. In this embodiment, the control circuit 20 can avoid creation of such an over-rich fuel-air mixture by changing the step period P from a first predetermined value P1 to a second, greater, predetermined value P2 so as to slow down the speed of movement of the throttle valve 2 when the throttle valve 2 closes to a reference angle $\theta c$.

Preferably, the reference angle $\theta c$ at which the step period P is changed from the first predetermined value P1 to the second, greater, predetermined value P2 is changed in accordance with engine operating conditions since the torsional vibration problem tends to occur at low engine speeds and depends on the engine speed at which deceleration is initiated. For example, if the step period P is changed from the first predetermined value P1 to the second, greater, predetermined value P2 at a high engine speed or if rapid deceleration is initiated at a high engine speed, a great amount of air is drawn into the engine, causing a reduction in engine brake efficiency so as to result in deceleration performance deterioration. If the reference angle $\theta c$ is set at a smaller value in order to avoid such deceleration performance deterioration, the intake-manifold negative pressure would increase to an excessive extent causing engine misfire, after-burning, and torque fluctuations when the engine is running at a low speed or deceleration is initiated at a low engine speed.

Figure 5:
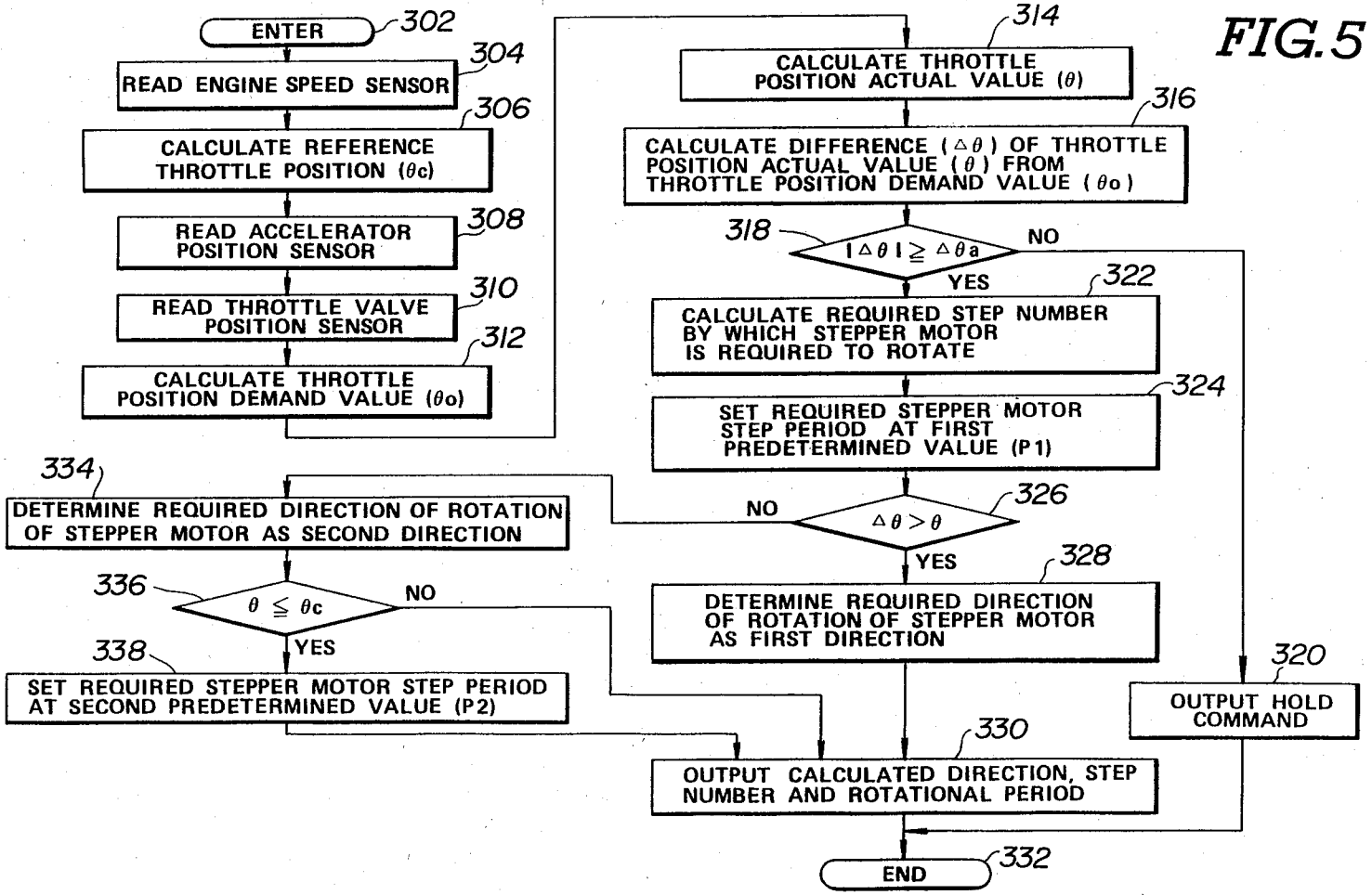
FIG. 5 is a flow diagram of the programming of the digital computer used in a second embodiment of the present invention.
Figure 6:
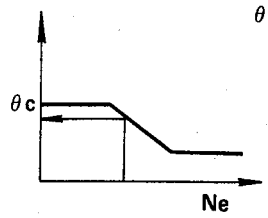
FIGS. 6 to 8 are graphs showing the relationship programmed into the computer.

A second embodiment of the present invention will be described with reference to FIG. 5 which is a flow diagram of the programming of the digital computer used in the control circuit. The second embodiment is generally the same as the first embodiment except that the control circuit 20 is arranged to change the reference angle $\theta c$ in accordance with engine speed. The computer program is entered at the point 302 at predetermined time intervals, or at appropriate times, or in synchronism with engine rotation. At the point 304 in the program, the engine rotational speed indicative signal is read into the computer memory 24. Following this, the program proceeds to the point 306 where the central processing unit 22 calculates a reference value $\theta c$ for the throttle valve position from a relationship programmed into the computer. This relationship is shown in FIG. 6 and it defines required reference value $\theta c$ as a function of engine rotational speed Ne. As shown in FIG. 6, the reference angle $\theta c$ is at a first constant when the engine speed Ne is less than a first speed value, at a second constant less than the first constant when the engine speed is greater than a second speed value, and at a variable decreasing from the first constant to the second constant as the engine speed increases when the engine speed is between the first and second speed values. The relationship may be modified in such a manner that the reference value $\theta c$ continuously decreases as the engine speed Ne increases.

Following this, the accelerator-pedal and throttle-valve position signals V1 and V2 are, one by one, converted by the analog-to-digital converter into digital form. Thus, at the point 308 in the program, the accelerator pedal position signal V1 is converted to digital form and read into the computer memory 24. At the point 310, the throttle valve position signal V2 is converted to digital form and read into the computer memory 24.

Figure 7:
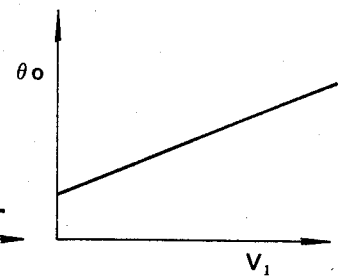
Figure 8:
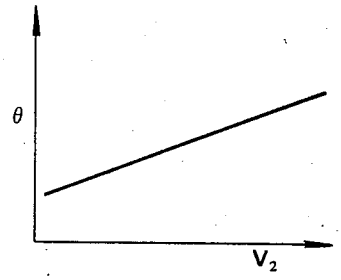

At the point 312 in the program, the central processing unit 22 calculates a demand value $\theta o$ for the throttle valve position from a relationship programmed into the computer. This relationship is shown in FIG. 7 and it defines throttle valve position demand value $\theta o$ as a function of throttle valve position signal V1. At the point 314, the central processing unit 22 calculates an actual value $\theta$ for the throttle valve position from a relationship programmed into the computer. This relationship is shown in FIG. 8 and it defines throttle valve position actual value $\theta$ as a function of throttle-valve position signal V2.

At the following point 316, the central processing unit 22 calculates the difference $\Delta\theta$ of the actual value $\theta$ from the demand value $\theta o$. At the point 318, a determination is made as to whether or not the absolute value of the calculated difference $\Delta\theta$ is equal to or greater than a predetermined value $\theta a$ which is intended to provide a dead zone. If the answer to this question is "no", then it means that the demand throttle valve change is within the dead zone and the program proceeds to the point 320. At the point 320, the central processing unit 22 outputs a hold command to the stepper motor control logic circuit 30 which thereby inhibits any stepper motor rotation so as to retain the throttle valve 2 at the existing position. Following this, the program proceeds to the end point 332.

If the answer to the question inputted at the point 318 is "yes", then the program proceeds to the point 322 where the central processing unit 22 calculates the number of steps by which the stepper motor 14 is required to rotate in each cycle of execution of this programming from a relationship programmed into the computer. This relationship is shown in FIG. 3 and it defines required step number STEP as a function of the absolute value $|\Delta\theta|$ of the calculated difference $\Delta\theta$. As shown in FIG. 3, the calculated step number STEP increases as the absolute value $|\Delta\theta|$ of the calculated difference increases. As a result, the stepper motor 14 rotates increased number of steps as the rate at which the accelerator pedal 1 is depressed or released increases.

At the point 324 in the program, the required step period P, which corresponds to the period in which the stepper motor 14 is to rotate by one step, is set at a first predetermined value P1. It is to be noted that the step period P is in inverse proportion to the required speed of rotation of the stepper motor 14 and thus to the speed of movement of the throttle valve 2. At the following point 326, a determination is made as to whether or not the calculated difference $\Delta\theta$ is greater than zero or positive. The sign of the calculated difference $\Delta\theta$ is positive when the required new setting $\theta o$ is greater than the sensed throttle valve position $\theta$ and it is negative when the former is less than the latter. If the answer to this question is "yes", then the program proceeds to the point 328 where the direction in which the stepper motor 14 is to rotate is determined as a first direction moving the throttle valve in an opening direction. Following this, the program proceeds to the point 330 where the central processing unit 22 transfers the calculated data in the form of the determined direction, the calculated step number and the calculated step period via the data bus 26 to the stepper motor control logic circuit 30 at the end of one cycle of execution of the computer program. The program proceeds from this point to the end point 332.

If the answer to the question inputted at the point 326 is "no", then the program proceeds to the point 334 where the direction in which the stepper motor 14 is to rotate is determined as a second direction moving the throttle valve in a closing direction. Following this, the program proceeds to the determination point 336. This determination is as to whether or not the actual value $\theta$ for the throttle valve position is equal to or less than the reference value $\theta c$ calculated at the point 306 in the program. If the answer to this question is "no", then the program proceeds to the point 330 where the central processing unit 22 transfers the calculated data including the determined dculated step number and the calculated step period via the data bus 26 to the stepper motor control logic circuit 30 at the end of one cycle of execution of the computer program. The program proceeds from this point to the end point 332.

If the answer to the question inputted at the point 336 is "yes", then the program proceeds to the point 338. At the point 338, the required step period P is set at a second predetermined value P2 greather than the first predetermined value P1. Following this, the program proceeds to the point 330 where the central processing unit 22 transfers the calculated data including the determined direction, the calculated step number and the calculated step period via the data bus 26 to the stepper motor control logic circuit 30 at the end of one cycle of execution of the computer program. The program proceeds from this point to the end point 332.

The stepper motor control logic circuit 30 includes a digital computer which stores the data transferred from the control circuit 20, calculates an appropriate bit pattern for the position of the throttle valve 2 based upon the stored data, and converts the calculated bit pattern into a corresponding pulse signal. The pulse signal is applied to the stepper motor drive circuit 40 which thereby rotates the stepper motor 14 to move the throttle valve 2 to its required new setting.

Figure 9:
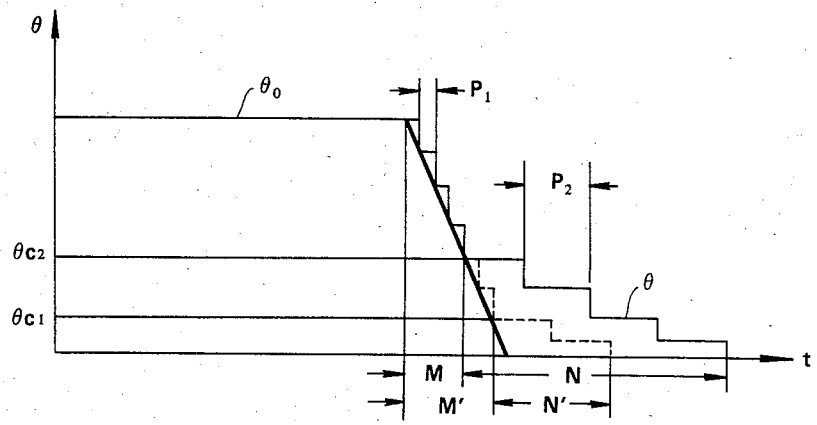
FIGS. 9 and 10 are diagrams explaining the operation of the second embodiment.
Figure 10:
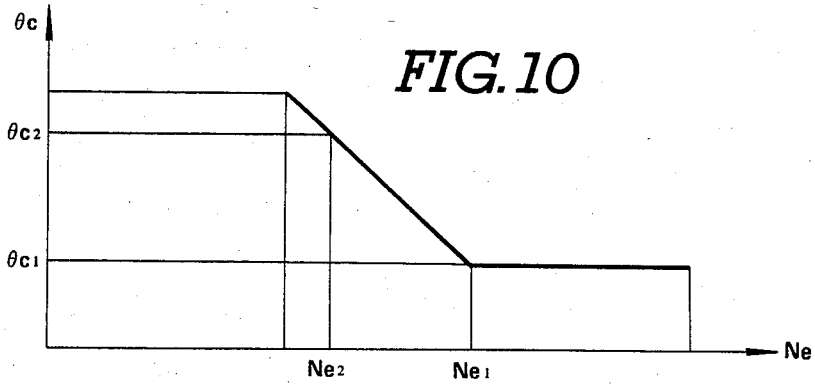

The operation of the second embodiment will be described with reference to FIGS. 9 and 10. Assuming first that the engine rotates at a speed Ne2, the control circuit 20 sets the reference angle $\theta c$ at a value $\theta c2$, as shown in FIG. 10. In this case, the control circuit 20 changes the step period P from a first predetermined value P1 to a second, greater, predetermined value P2 so as to avoid creation of an over-rich fuel-air mixture when the throttle valve 2 moves in a closing direction to the reference angle $\theta c2$. In FIG. 9, the range M indicates the period during which the control circuit 20 selects the first predetermined step period P1 and the range N indicates the period during which the control circuit 20 selects the second, greater, predetermined step period P2 so as to slow down the speed of movement of the throttle valve 2.

If the engine rotates at a speed Ne1 higher than the speed Ne2, the control circuit 20 sets the reference angle $\theta c$ at a value $\theta c1$ smaller than the value $\theta c2$, as shown in FIG. 10. In this case, the control circuit 20 changes the step period P from a first predetermined value P1 to a second, greater, predetermined value P2 so as to slow down the speed of movement of the throttle valve 2 when the throttle valve 2 moves in a closing direction to the reference angle $\theta c1$. In other words, the time period M' during which the step period P remains at the first predetermined value P1 is elongated so as to provide high engine brake efficiency. It is, therefore, possible to minimize the torque fluctuations resulting in uncomfortable torsional vibration of the engine since the engine is rotating at a high speed although the step period P is changed to the second, greater, predetermined period when the throttle valve position is at a relatively small angle.

The reference angle $\theta c$ at which the step period P is changed to the second, greater, predetermined value P2 increases at predetermined time intervals during deceleration.

For example, if the accelerator pedal 1 is released for deceleration when the vehicle is running on a level road, the engine speed will decrease at a relatively high rate. Under this condition, the control circuit 20 changes the step period P to the second, greater, predetermined value P2 when the throttle valve closes to a relatively great angle so as to avoid torque fluctuations resulting in uncomfortable torsional vibration of the engine. If the accelerator pedal 1 is released for deceleration when the vehicle is running on a gentle downward slop, the engine rotational speed will decrease at a relatively low rate. Under this condition, the control circuit 20 changes the step period P to the second, greater, predetermined value P2 when the throttle valve closes to a relatively small angle after engine brake is applied to a sufficient extent.

That is, it is desired to take preference of engine brake application when the engine speed at which acceleration is initiated is high and of torsional vibration avoidance when the engine speed at which acceleration is initiated is low. It is, therefore, understood that the reference angle $\theta c$ at which the step period P is changed to the second, greater, predetermined value P2 may be determined in accordance with the engine speed at which deceleration is initiated. The engine speed at which deceleration is initiated may be inferred from detection of the transmission gear position.

A third embodiment of the present invention will be described with reference to FIG. 11 which is a flow diagram of the programming of the digital computer used in the control circuit. The third embodiment is generally similar to the second embodiment except that the control circuit 20 is arranged to change the reference angle $\theta c$ in accordance with transmission gear position.

The computer program is entered at the point 402 at predetermined time intervals, or at appropriate times, or in synchronism with engine rotation. At the point 404 in the program, the gear position sensor 16 is read. Following this, the program proceeds to the point 306 where the central processing unit 22 selects one of predetermined reference values $\theta c1$ to $\theta c5$ from a relationship programmed into the computer. This relationship is shown in FIG. 12 and it defines required reference value $\theta c$ as a function of selected transmission gear position. That is, the central processing unit 22 selects a reference angle $\theta c1$ when the transmission is in a first gear G1, a reference angle $\theta c2$ when the transmission is in a second gear G2, a reference angle $\theta c3$ when the transmission is in a third gear G3, a reference angle $\theta c4$ when the transmission is in a fourth gear G4, and a reference angle $\theta c5$ when the transmission in a fifth gear G5. The reference values $\theta c1$ to $\theta c5$ are preset in such a manner that a smaller reference angle $\theta c$ is selected when a higher gear is selected in the transmission. It is to be noted that the relationship may be modified in such a manner that the central processing unit 22 selects a first reference angle when the transmission is in low gear and a second, smaller, reference angle when the transmission is in high gear.

Following this, the accelerator-pedal and throttle-valve position signals V1 and V2 are, one by one, converted by the analog-to-digital converter into digital form. Thus, at the point 408 in the program, the accelerator pedal position signal V1 is converted to digital form and read into the computer memory 24. At the point 410, the throttle valve position signal V2 is converted to digital form and read into the computer memory 24.

At the point 412 in the program, the central processing unit 22 calculates a demand value $\theta o$ for the throttle valve position from a relationship programmed into the computer. This relationship is shown in FIG. 7 and it defines throttle valve position demand value $\theta o$ as a function of throttle valve position signal V1. At the point 414, the central processing unit 22 calculates an actual value $\theta$ for the throttle valve position from a relationship programmed into the computer. This relationship is shown in FIG. 8 and it defines throttle valve position actual value $\theta$ as a function of throttle valve position signal V2.

At the following point 416, the central processing unit 22 calculates the difference $\Delta\theta$ of the actual value $\theta$ from the demand value $\theta o$. At the point 418, a determination is made as to whether or not the absolute value of the calculated difference $\Delta\theta$ is equal to or greater than a predetermined value $\Delta\theta a$ which is intended to provide a dead zone. If the answer to this question is "no", then it means that the required throttle valve change is within the dead zone and the program proceeds to the point 420. At the point 420, the central processing unit 22 outputs a hold command to the stepper motor control logic circuit 30 which thereby inhibits any stepper motor rotation so as to hold the throttle valve 2 at the existing position. Following this, the program proceeds to the end point 432.

If the answer to the question inputted at the point 418 is "yes", then the program proceeds to the point 422 where the central processing unit 22 calculates calculates the number of step by which the stepper motor 14 is required to rotate in each cycle of execution of this program from a relationship programmed into the computer. This relationship is shown in FIG. 3 and it defines required step number STEP as a function of the absolute value $|\Delta\theta|$ of the calculated difference $\Delta\theta$. As shown in FIG. 3, the calculated step number STEP increases as the absolute value $|\Delta\theta|$ of the calculated difference $\Delta\theta$ increases. As a result, the stepper motor 14 rotates increased number of steps as the rate at which the accelerator pedal 1 is depressed or released increases.

At the point 424 in the program, the required step period P, which determines the period in which the stepper motor 14 is to rotate by one step, is set at a first predetermined value P1. It is to be noted that the step period P is in inverse proportion to the required speed of rotation of the stepper motor 14 and thus to the speed of movement of the throttle valve 2. At the following point 426, a determination is made as to whether or not the calculated difference $\Delta\theta$ is greater than zero or positive. The sign of the calculated difference $\Delta\theta$ is positive when the required new setting $\theta o$ is greater than the sensed throttle valve position $\theta$ and it is negative when the former is less than the latter. If the answer to this question is "yes", then the program proceeds to the point 428 where the direction in which the stepper motor 14 is to rotate is determined as a first direction moving the throttle valve in an opening direction. Following this, the program proceeds to the point 430 where the central processing unit 22 transfers the calculated data in the form of the determined direction, the calculated step number, and the calculated step period via the data bus 26 to the stepper motor control logic circuit 30 at the end of one cycle of the computer program. The program proceeds from this point to the end point 432.

If the answer to the question inputted at the point 426 is "no", then the program proceeds to the point 434 where the direction in which the stepper motor 14 is to rotate is determined as a second direction moving the throttle valve in a closing direction. Following this, the program proceeds to the determination point 436. This determination is as to whether or not the actual value $\theta$ for the throttle valve position is equal to or less than the reference value $\theta c$ selected at the point 406 in the program. If the answer to this question is "no", then the program proceeds to the point 430 where the central processing unit 22 transfers the calculated data including the determined direction, the calculated step number, and the calculated step period via the data bus 26 to the stepper motor control logic circuit 30 at the end of one cycle of execution of the computer program. The program proceeds from this point to the end point 432.

If the answer to the question inputted at the point 436 is "yes", then the program proceeds to the point 438. At the point 438, the required step period P is set at a second predetermined value P2 greater than the first predetermined value P1. Following this, the program proceeds to the point 430 where the central processing unit 22 transfers the calculated data including the determined direction, the calculated step number, and the calculated step period via the data bus 26 to the stepper motor control logic circuit 30 at the end of one cycle of execution of the computer program. The program proceeds from this point to the end point 432.

The stepper motor control logic circuit 30 includes a digital computer which stores the data transferred from the control circuit 20, calculates an appropriate bit pattern for the position of the throttle valve 2 based upon the stored data, and converts the calculated bit pattern into a corresponding pulse signal. The pulse signal is applied to the stepper motor drive circuit 40 which thereby rotates the stepper motor 14 to move the throttle valve 2 to a new position.

In this embodiment, the control circuit 20 changes the step period P from a first predetermined value P1 to a second, greater, predetermined value P2 so as to slow down the speed of movement of the throttle valve 2 when the throttle valve 2 moves in a closing direction to a selected reference position $\theta c$. Since a greater reference position $\theta c$ is selected when the transmission is in a lower gear, the step period P is changed to a second, greater, predetermined value P2 to slow down the speed of movement of the throttle valve 2 from an earlier stage of deceleration than when the transmission is in a higher gear.

A fourth embodiment of the present invention will be described with reference to FIG. 13 which is a flow diagram of the programming of the digital computer used in the control circuit. The fourth embodiment is generally similar to the first embodiment except that the control circuit 20 is arranged to vary the second stepper motor step period in accordance with engine speed variations.

The computer program is entered at the point 502 at predetermined time intervals, or at appropriate times, or in synchronism with engine rotation. At the point 504 in the program, the engine speed sensor 15 is read into the computer memory 24. Following this, the program proceeds to the point 506 where the central processing unit 22 calculates a second stepper motor step period P2 from a relationship programmed into the computer. This relationship is shown in FIG. 14 and it defines required second step period P2 as a function of engine rotational speed Ne. As shown in FIG. 14, the second step period P2 is at a first constant when the engine speed Ne is less than a first value, at a second constant less than the first constant when the engine speed is greater than a second value, and at a variable decreasing from the first constant to the second constant as the engine speed increases when the engine speed is between the first and second speed values. The relationship may be modified in such a manner that the second step period P2 decreases as the engine speed Ne increases.

Following this, the accelerator-pedal and throttle-valve position signals V1 and V2 are, one by one, converted by the analog-to-digital converter into digital form. Thus, at the point 508 in the program, the accelerator pedal position signal V1 is converted into digital form and read into the computer memory 24. Similarly, at the point 510, the throttle valve position signal V2 is converted to digital form and read into the computer memory 24.

At the point 512 in the program, the central processing unit 22 calculates a demand value $\theta o$ for the throttle valve position from a relationship programmed into the computer. This relationship is shown in FIG. 7 and it defines throttle valve position demand value $\theta o$ as a function of throttle valve position signal V1. At the point 514, the central processing unit 22 calculates an actual value $\theta$ for the throttle valve position from a relationship programmed into the computer. This relationship is shown in FIG. 8 and it defines throttle valve position actual value $\theta$ as a function of throttle valve position signal V2.

At the following point 516, the central processing unit 22 calculates the difference $\Delta\theta$ of the actual value $\theta$ from the demand value $\theta o$. At the point 518, a determination is made as to whether or not the absolute value of the calculated difference $\Delta\theta$ is equal to or greater than a predetermined value $\Delta\theta a$ which is intended to provide a dead zone. If the answer to this question is "no", then it means that the required throttle valve change is within the dead zone and the program proceeds to the point 520. At the point 520, the central processing unit 22 outputs a hold command to the stepper motor control logic circuit 30 which thereby inhibits any stepper motor rotation so as to hold the throttle valve 2 at the existing position. Following this, the program proceeds to the end point 532.

If the answer to the question inputted at the point 518 is "yes", then the program proceeds to the point 522 where the central processing unit 22 calculates the number of step by which the stepper motor 14 is required to rotate in each cycle of execution of this program from a relationship programmed into the computer. This relationship is shown in FIG. 3 and it defines required step number STEP as a function of the absolute value $|\Delta\theta|$ of the calculated difference $\Delta\theta$. As a result, the stepper motor 14 rotates increased number of steps as the rate at which the accelerator pedal 1 is depressed or released increases.

At the point 524 in the program, the required step period P, which determines the period in which the stepper motor 14 is to rotate by one step, is set at a first predetermined value P1. It is to be noted that the step period P is in inverse proportion to the required speed of rotation of the stepper motor 14 and thus to the speed of movement of the throttle valve 2. At the following point 526, a determination is made as to whether or not the calculated difference $\Delta\theta$ is greater than zero or positive. The sign of the calculated difference $\Delta\theta$ is positive when the required new setting $\theta o$ is greatner than the sensed throttle valve position $\theta$ and it is negative when the former is less than the latter. It is to be understood that this determination may be made in accordance with engine speed. If the answer to this question is "yes", then the program proceeds to the point 528 where the direction in which the stepper motor 14 is to rotate is determined as a first direction moving the throttle valve in an opening direction. Following this, the program proceeds to the point 530 where the central processing unit 22 transfers the calculated data including the determined direction, the calculated step number, and the calculated step period via the data bus 26 to the stepper motor control logic circuit 30 at the end of one cycle of the computer program. The program proceeds from this point to the end point 532.

If the answer to the question inputted at the point 526 is "no", then the program proceeds to the point 534 where the direction in which the stepper motor 14 is to rotate is determined as a second direction moving the throttle valve 2 in a closing direction. Following this, the program proceeds to the determination point 536. This determination is as to whether or not the actual value $\theta$ for the throttle valve position is equal to or less than a reference value $\theta c$. If the answer to this question is "no", then the program proceeds to the point 530 where the central processing unit 22 transfers the calculated data including the determined direction, the calculated step number, and the calculated step period via the data bus 26 to the stepper motor control logic circuit 30 at the end of one cycle of execution of the computer program. The program proceeds from this point to the end point 532.

If the answer to the question inputted at the point 536 is "yes", then the program proceeds to the point 538. At the point 538, the required step period P is set at the second greater value P2 calculated at the point 506 in the program. Following this, the program proceeds to the point 530 where the central processing unit 22 transfers the calculated data including the determined direction, the calculated step number, and the calculated step period via the data bus 26 to the stepper motor control logic circuit 30 at the end of one cycle of execution of the computer program. The program proceeds from this point to the end point 532.

The stepper motor control logic circuit 30 includes a digital computer which stores the data transferred from the control circuit 20, calculates an appropriate bit pattern for the position of the throttle valve 2 based upon the stored data, and converts the calculated bit pattern into a corresponding pulse signal. The pulse signal is applied to the stepper motor drive circuit 40 which thereby rotates the stepper motor 14 to move the throttle valve 2 to its required new setting.

The operation of the fourth embodiment will be described with reference to FIGS. 15 and 16. Assuming now that the throttle valve position is at an angle greater than the reference value $\theta c$ when a demand for deceleration occurs, the control circuit 20 sets the step period P at the first predetermined value P1 so as to move the throttle valve in a closing direction at a constant rate which is in inverse proportion to the set value P1, as shown in the range M of FIG. 15. When the throttle valve closes to the reference position $\theta c$, the control circuit 20 changes the step period P from the first predetermined value P1 to a second value P2, as shown in the range N of FIG. 15. The second step period value P2 varies in accordance with engine speed, as shown in FIG. 16.

If the engine speed Ne is at a value greater than a value Na when the throttle valve reaches the reference position $\theta c$, the control circuit 22 sets the second step period at a predetermined value P21, as shown in FIG. 16, and changes the step period P from the first predetermined value to the second, greater, predetermined value P21. As a result, the throttle valve 2 closes at a rate less than when the throttle valve position is at an angle greater than the reference value $\theta c$, as shown in the range N1 of FIG. 15. When the engine speed Ne decreases to a value less than the value Na, the control circuit 20 changes the step period P from the value P21 to a value P22 which increases as the engine speed decreases, as shown in FIG. 16. As a result, the speed of closing movement of the throttle valve 2 decreases as the engine speed decreases, as shown in the range N2 of FIG. 16. When the engine speed Ne further decreases to a value less than the value Nb, the control circuit 20 sets the step period P at a predetermined value P23 which is greater than the value P22, as shown in FIG. 16, and changes the step period P from the value P22 to the predetermined value P23. As a result, the throttle valve 2 closes at a constant small rate which is in inverse proportion to the step period P23, as shown in the range N3 of FIG. 15.

If the engine speed is relatively low when the throttle valve position reaches the reference angle $\theta c$, the throttle valve closes at a relatively low speed, as indicated by the broken curve of FIG. 15, so as to avoid uncomfortable torsional vibration of the engine. If the engine speed is relatively high when the throttle position reaches the reference angle $\theta c$, the throttle valve closes at a relatively high speed during the early stage of the deceleration and at a relatively slow speed during the subsequent stage of the deceleration, as indicated by the solid curve of FIG. 15, so as to provide efficient engine brake and avoid uncomfortable torsional vibration of the engine.

As previously stated, it is desired to take preference of engine brake efficiency when the engine speed at which acceleration is initiated is high and of torsional vibration avoidance when the engine speed at which acceleration is initiated is low. It is, therefore, understood that the second step period value P2 may be determined in accordance with the engine speed at which deceleration is initiated. The engine speed at which deceleration is initiated may be inferred from detection of the transmission gear position.

Figures 17, 18:
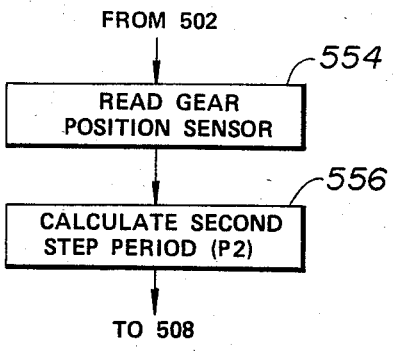
FIG. 17 is a flow diagram showing a modification of the fourth embodiment.
FIG. 18 is a table showing the relationship programmed into the computer.

A modified form of the fourth embodiment will be described with reference to FIG. 17 which is a part of a flow diagram of the programming of the digital computer used in the control circuit 20. This modification is different from the fourth embodiment only in that the control circuit 20 is arranged to change the second step period value P2 in accordance with transmission gear position.

In this modification, the points 504 and 506 are removed and replaced by points 554 and 556. At the point 554 in the program, the gear position sensor 16 is read. At the point 556, the central processing unit 22 selects one of predetermined values Pg1 to Pg5 for the second step period P2 from a relationship programmed into the computer. This relationship is shown in FIG. 18 and it defines required second step period P2 as a function of selected transmission gear position. For example, the central processing unit 22 selects a value Pg1 when the transmission is in a first gear G1, a value Pg2 when the transmission is in a second gear G2, a value Pg3 when the transmission is in a third gear G3, a value Pg4 when the transmission is in a fourth gear G4, and a value Pg5 when the transmission is in a fifth gear G5. These values Pg1 to Pg5 are preset in such a manner that a smaller second step period value P2 is selected when a higher gear is selected in the transmission. It is to be noted that the relationship may be modified in such a manner that the central processing unit 22 selects a first predetermined value when the transmission is in low gear and a second, smaller, predetermined value when the transmission is in high gear. The calculated second step period P2 is used at the point 538 of FIG. 14. The program proceeds from the point 556 of the point 508 of FIG. 13.

Figure 19:
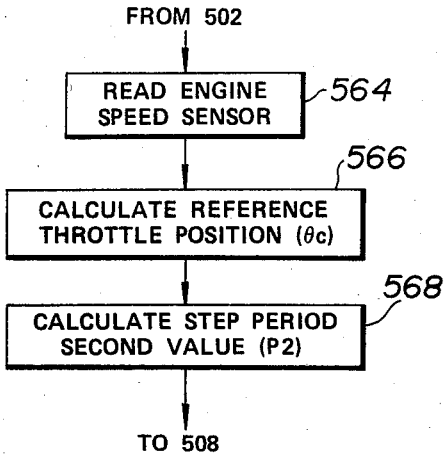
FIGS. 19 and 20 are flow diagrams showing alternative modifications of the fourth embodiments.

Referring to FIG. 19, there is illustrated another modification of the fourth embodiment wherein the points 504 and 506 are removed and replaced by points 564, 566 and 568. At the point 564 in the program, the engine speed sensor 15 is read. At the point 566, the central processing unit 22 calculates a reference value $\theta c$ for the throttle valve position from a relationship programmed into the computer. This relationship is shown in FIG. 6 and it defines required reference angle $\theta c$ as a function of engine rotational speed Ne. As shown in FIG. 6, the reference value $\theta c$ decreases as the engine rotational speed Ne increases. The calculated reference angle $\theta c$ is used at the determination point 536 of FIG. 13. At the point 568 in the program, the central processing unit 22 calculates a second stepper motor step period P2 from a relationship programmed into the computer. This relationship is shown in FIG. 14 and it defines required second step period P2 as a function of engine rotational speed Ne. As shown in FIG. 14, the second step period P2 decreases as the engine rotational speed Ne increases. The calculated second step period P2 is used at the point 538 of FIG. 13. The program proceeds from the point 568 to the point 508 of FIG. 13.

In this modification, both of the reference throttle valve position $\theta c$ at which the stepper motor step period P is changed from a first predetermined value P1 to a second smaller value P2 to slow down the speed of closing movement of the throttle valve 12 and the second stepper motor step period P2 are varied in accordance with engine rotational speed Ne so as to provide more accurate throttle valve control.

Figure 20:
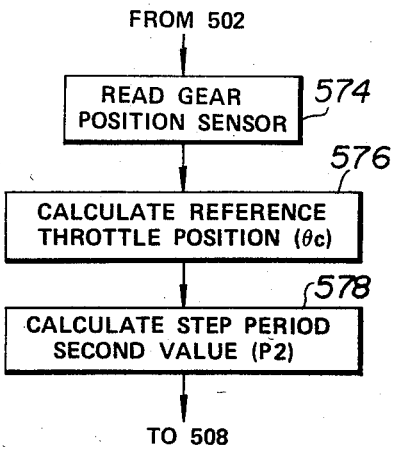

Referring to FIG. 20, there is illustrated another modification of the fourth embodiment wherein the points 504 and 506 are removed and replaced by points 574, 576 and 578. At the point 574 in the program, the gear position sensor 16 is read. At the point 576, the central processing unit 22 selects one of predetermined values $\theta c1$ to $\theta c5$ for the throttle valve reference position $\theta c$ from a relationship programmed into the computer. This relationship is shown in FIG. 12 and it defines required reference value $\theta c$ as a function of selected transmission gear position. The central processing unit 22 selects a reference angle $\theta c1$ when the transmission is in a first gear G1, a reference angle $\theta c2$ when the transmission is in a second gear G2, a reference angle $\theta c3$ when the transmission is in a third gear G3, a reference angle $\theta c4$ when the transmission is in a fourth gear G4, and a reference angle $\theta c5$ when the transmission is in a fifth gear G5. The reference angles $\theta c1$ to $\theta c5$ are preset in such a manner that a smaller reference angle $\theta c$ is selected when a higher gear is selected in the transmission. It is to be noted that the relationship may be modified in such a manner that the central processing unit 22 selects a first reference angle when the transmission is in low gear and a second, smaller, reference angle when the transmission is in high gear. The selected reference angle $\theta c$ is used at the determination point 536 of FIG. 13.

Following this, the program proceeds to the point 578 where the central processing unit 22 selects one of predetermined values Pg1 to Pg5 for the second step period P2 from a relationship programmed into the computer. This relationship is shown in FIG. 18 and it defines required second step period P2 as a function of selected transmission gear position. For example, the central processing unit 22 selects a value Pg1 when the transmission is in a first gear G1, a value Pg2 when the transmission is in a second gear G2, a value Pg3 when the transmission is in a third gear G3, a value Pg4 when the transmission is in a fourth gear G4, and a value Pg5 when the transmission is in a fifth gear G5. These values Pg1 to Pg5 are preset in such manner that a smaller second step period value P2 is selected when a higher gear is selected in the transmission. It is to be noted that the relationship may be modified in such a manner that the central processing unit 22 selects a first predetermined value when the transmission is in low gear and a second, smaller, predetermined value when the transmission is in high gear. The selected second step period value is used at the point 538 of FIG. 13. The program proceeds from the point 578 to the point 508 of FIG. 13.

In this modification, both of the reference throttle valve position $\theta c$ at which the stepper motor step period P is changed from a first predetermined value P1 to a second smaller value P2 to slow down the speed of closing movement of the throttle valve 12 and the second stepper motor step period P2 are varied in accordance with selected transmission gear position so as to provide more accurate throttle valve control.

Figure 22:
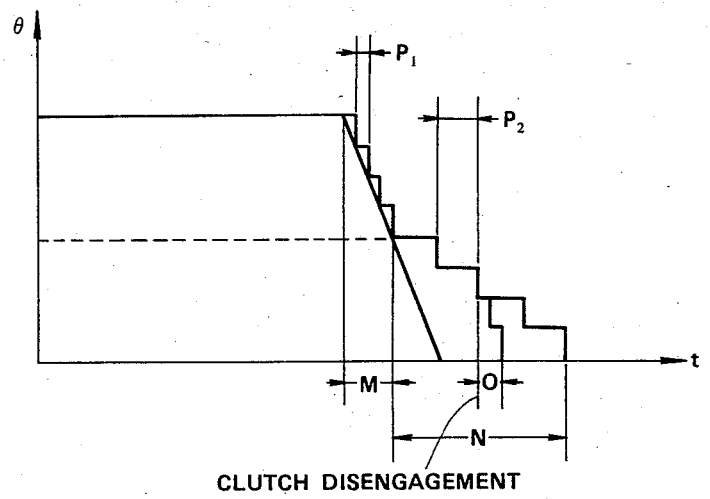
FIG. 22 is a graph used in explaining the operation of the fifth embodiment.
Figure 21:
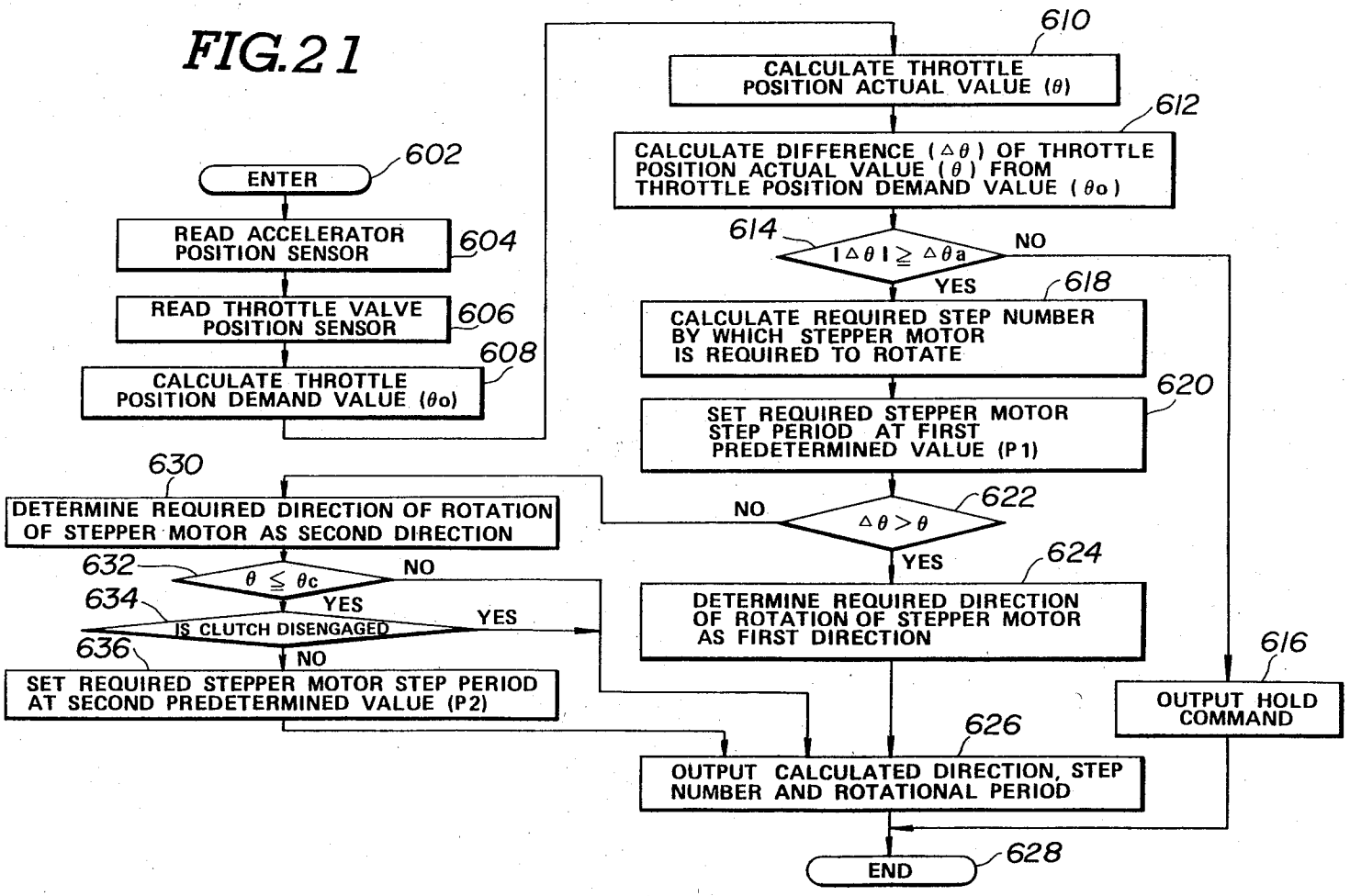
FIG. 21 is a flow diagram of the programming of the digital computer used in a fifth embodiment of the present invention.

A fifth embodiment of the present invention will be described with reference to FIG. 22 which is a flow diagram of the programming of the digital computer used in the control circuit 20. The fifth embodiment is generally similar to the first embodiment except that the control circuit 20 is arranged to inhibit the change of the step period P from a first predetermined value P1 to a second, greater, predetermined value P2 when the clutch is disengaged.

The computer program is entered at the point 602 at predetermined time intervals or in synchronism with engine rotation. Following this, the accelerator-pedal and throttle-valve position signals V1 and V2 are, one by one, converted by the analog-to-digital converter 21 into digital form. Thus, at the point 604 in the program, the accelerator pedal position signal V1 is converted into digital form and read into the computer memory 24. Similarly, at the point 606, the throttle valve position signal V2 is converted to digital form and read into the computer memory 24.

At the point 608 in the program, the central processing unit 22 calculates a demand value $\theta c$ for the throttle valve position from a relationship programmed into the computer. This relationship is shown in FIG. 7 and it defines throttle valve position demand value $\theta o$ as a function of throttle valve position signal V1. At the point 610, the central processing unit 22 calculates an actual value $\theta$ for the throttle valve position from a relationship programmed into the computer. This relationship is shown in FIG. 8 and it defines throttle valve position actual value $\theta$ as a function of throttle valve position signal V2.

At the following point 612, the central processing unit 22 calculates the difference $\Delta\theta$ of the actual value $\theta$ from the demand value $\theta o$. At the point 614, a determination is made as to whether or not the absolute value of the calculated difference $\Delta\theta$ is equal to or greater than a predetermined value $\Delta\theta a$ which is intended to provide a dead zone. If the answer to this question is "no", then it means that the required throttle valve change is within the dead zone and the program proceeds to the point 616. At the point 616, the central processing unit 22 outputs a hold command to the stepper motor control logic circuit 30 which thereby inhibits any stepper motor rotation so as to hold the throttle valve 2 at the existing position. Following this, the program proceeds to the end point 628.

If the answer to the question inputted at the point 614 is "no", then the program proceeds to the point 618 where the central processing unit 22 calculates the number of step by which the stepper motor 14 is required to rotate in each cycle of execution of this program from a relationship programmed into the computer. This relationship is shown in FIG. 3 and it defines required step number STEP as a function of the absolute value $|\Delta\theta|$ of the calculated difference $\Delta\theta$. As a result, the stepper motor 14 rotates increased number of steps as the rate at which the accelerator pedal 1 is depressed or released increases.

At the point 620 in the program, the required step period P, which determines the period in which the stepper motor 14 is to rotate by one step, is set at a first predetermined value P1. It is to be noted that the step period P is in inverse proportion to the required speed of rotation of the stepper motor 14 and thus to the speed of movement of the throttle valve 2. At the following point 614, a determination is made as to whether or not the calculated difference $\Delta\theta$ is greater than zero or positive. The sign of the calculated difference $\Delta\theta$ is positive when the required new setting $\theta o$ is greater than the sensed throttle valve position $\theta$ and it is negative when the former is less than the latter. It is to be understood that this determination may be made in accordance with engine rotational speed. If the answer to this question is "yes", then the program proceeds to the point 624 where the direction in which the stepper motor 14 is to rotate is determined as a first direction moving the throttle valve in an opening direction. Following this, the program proceeds to the point 626 where the central processing unit 22 transfers the calculated data including the determined direction, the calculated step number, and the calculated step period via the data bus 26 to the stepper motor control logic circuit 30 at the end of one cycle of the computer program. The program proceeds from this point to the end point 628.

If the answer to the question inputted at the point 622 is "no", then the program proceeds to the point 630 where the direction in which the stepper motor 14 is to rotate is decided as a second direction moving the throttle valve 2 in a closing direction. Following this, the program proceeds to the determination point 632. This determination is as to whether or not the actual value $\theta$ for the throttle valve position is equal to or less than a predetermined reference value $\theta c$. If the answer to this question is "no", then the program proceeds to the point 626 where the central processing unit 22 transfers the calculated data including the determined direction, the calculated step number, and the calculated step period via the data bus 26 to the stepper motor control logic circuit 30 at the end of one cycle of execution of the computer program. The program proceeds from this point to the end point 626.

If the answer to the question inputted at the point 632 is "yes", then the program proceeds to the point 634 where another determination is made. This determination is as to whether or not the clutch is disengaged. If the answer to this question is "yes", then the program proceeds to the point 626. Otherwise, the program proceeds to the point 636 where the required step period P is set at a second, greater, predetermined value P2. Following this, the program proceeds to the point 626 where the central processing unit 22 transfers the calculated data including the determined direction, the calculated step number, and the calculated step period via the data bus 26 to the stepper motor control logic circuit 30 at the end of one cycle of execution of the computer program. The program proceeds from this point to the end point 532.

The stepper motor control logic circuit 30 includes a digital computer which stores the data transferred from the control circuit 20, calculates an appropriate bit pattern for the position of the throttle valve 2 based upon the stored data, and converts the calculated bit pattern into a corresponding pulse signal. The pulse signal is applied to the stepper motor drive circuit 40 which thereby rotates the stepper motor 14 to move the throttle valve 2 to its required new setting.

The operation of the fifth embodiment will be described with reference to FIG. 22. Assuming now that the throttle valve position is at an angle greater than the reference angle $\theta c$ when a demand for deceleration occurs, the control circuit 20 sets the step period P at the first predetermined value P1 so as to move the throttle valve in a closing direction at a cosntant rate which is in inverse proportion to the set value P1, as shown in the range M of FIG. 22. When the throttle valve closes to the reference angle $\theta c$, the control circuit 20 changed the step period P from the first predetermined value P1 to a second, greater, predetermined value P2 so as to slow down the speed of closing movement of the throttle valve, as shown in the range N of FIG. 22. If the clutch is disengaged, the control circuit 20 changes the step period P from the second predetermined value P2 to the first, smaller, predetermined value P1 to increase the speed of closing movement of the throttle valve, as shown in the range 0 of FIG. 22, so as to suppress sudden engine speed increase which results in poor drivability and poor fuel economy.

Although the present invention has been described in connection with a control circuit used in a closed loop system having a throttle valve position sensor which provides a feedback signal causing the control circuit to move the throttle valve to a desired position, it is to be noted that the control circuit may be used in an open loop system. In this case, the control circuit may have an input from a counter which counts the number of pulses applied to the step motor so as to measure the stepper motor angular position which provides a direct indication of the throttle valve position. In addition, the stepper motor may be removed and replaced with a DC servo motor, in which case, the control circuit 20 may be arranged to change the speed of rotation of the DC servo motor from a first predetermined value to a second, smaller, predetermined value when the throttle valve closes to a predetermined angle.

Although this invention has been described in conjunction with specific embodiments thereof, it is evident that many alternatives, modifications and variations will be apparent to those skilled in the art. Accordingly, it is intended to embrace all alternatives, modifications and variations that fall within the broad scope of the appended claims.

What is claimed is:

1. An apparatus for use with an automotive vehicle having an accelerator pedal and a throttle valve for controlling movement of said throttle valve in response to a change in the position of said accelerator pedal, comprising:

signal sources for generating an electrical signal indicative of the position of said accelerator pedal and an electrical signal indicative of the position of said throttle valve;

a control circuit for calculating a value corresponding to a setting of the position of said throttle valve in response to said accelerator-pedal and throttle-valve position signals;

an actuator connected to said control circuit for moving said throttle valve to said calculated setting; and said control circuit including means for comparing the throttle valve position with a reference angle, and means for decreasing the speed of closing movement of said throttle valve when the throttle valve position is at an angle equal to or less than said reference angle.

2. The apparatus as claimed in claim 1, wherein said control circuit includes means for setting the speed of closing movement of said throttle valve at a first predetermined value when the position of said throttle valve is at an angle greater than said reference angle and at a secpnd value less than said first predetermined value when the throttle valve position is at an angle equal to or less than said reference angle.

3. The apparatus as claimed in claim 2, wherein said control circuit includes means for varying said reference angle in accordance with engine speed.

4. The apparatus as claimed in claim 3, wherein said control circuit includes means for setting said reference angle at a first constant when the engine speed is less than a first speed value, at a second constant less than said first constant when the engine speed is greater than a second speed value, and at a variable decreasing from said first constant to said second constant as the engine speed increases when the engine speed is between said first and second speed values.

5. The apparatus as claimed in claim 2, wherein said control circuit includes means for varying said second value in accordance with engine speed.

6. The apparatus as claimed in claim 5, wherein said control circuit includes means for setting said second value at a first constant when the engine speed is less than a first speed value, at a second constant greater than said first constant when the engine speed is greater than a second speed value, and at a variable increasing from said first constant to said second constant as the engine speed increases when the engine speed is between said first and second speed value.

7. The apparatus as claimed in claim 2, wherein said control circuit includes means for varying said reference angle in accordance with transmission gear position.

8. The apparatus as claimed in claim 7, wherein said control circuit includes means for setting said reference angle at a greater value when a lower speed gear is selected.

9. The apparatus as claimed in claim 2, wherein said control circuit includes means for varying said second value in accordance with transmission gear position.

10. The apparatus as claimed in claim 9, wherein said control circuit including means for setting said second value at a greater value when a higher speed gear is selected.

11. The apparatus as claimed in claim 2, wherein said control circuit includes means for varying said reference angle and said second value in accordance with engine speed.

12. The apparatus as claimed in claim 11, wherein said control circuit includes:

means for setting said reference angle at a first constant when the engine speed is less than a first speed value, at a second constant less than said first constant when the engine speed is greater than a second speed value, and at a variable decreasing from said first constant to said second constant as the engine speed increases when the engine speed is between said first and second speed values; and means for setting said second value at a first constant when the engine speed is less than a first speed value, at a second constant greater than said first constant when the engine speed is greater than a second speed value, and at a variable increasing from said first constant the said second constant as the engine speed increases when the engine speed is between said first and second speed value.

13. The apparatus as claimed in claim 2, wherein said control circuit includes means for varying said reference angle and said second value in accordance with transmission gear position.

14. The apparatus as claimed in claim 13, wherein said control circuit includes:

means for setting said reference angle at a smaller value when a higher speed gear is selected; and means for setting said second value at a greater value when a higher speed gear is selected.

15. The apparatus as claimed in claim 2, wherein said control circuit includes means associate

* * * * *